US011566501B2

(12) United States Patent
Moneyhun et al.

(10) Patent No.: US 11,566,501 B2
(45) Date of Patent: Jan. 31, 2023

(54) APPARATUS FOR CONDITIONING NATURAL GAS FOR USE IN GAS LIFT ARTIFICIAL LIFT APPLICATIONS IN OIL AND GAS PRODUCTION

(71) Applicant: Moneyhun Equipment Sales, Rock Springs, WY (US)

(72) Inventors: David Moneyhun, Rock Springs, WY (US); Bernie Claydon, Rock Springs, WY (US)

(73) Assignee: Moneyhun Equipment Sales & Service Co., Inc., Rock Springs, WY (US)

( * ) Notice: Subject to any disclaimer, the term of this patent is extended or adjusted under 35 U.S.C. 154(b) by 349 days.

(21) Appl. No.: 16/911,998

(22) Filed: Jun. 25, 2020

(65) Prior Publication Data

US 2021/0002989 A1 Jan. 7, 2021

Related U.S. Application Data

(60) Provisional application No. 62/869,686, filed on Jul. 2, 2019.

(51) Int. Cl.
*E21B 43/40* (2006.01)
*E21B 43/12* (2006.01)

(52) U.S. Cl.
CPC ..... *E21B 43/122* (2013.01); *E21B 43/40* (2013.01)

(58) Field of Classification Search
CPC ..... E21B 43/40
See application file for complete search history.

(56) References Cited

U.S. PATENT DOCUMENTS

| | | | | |
|---|---|---|---|---|
| 10,017,701 | B2 | 7/2018 | Meyer | |
| 10,322,397 | B2 * | 6/2019 | Visser | C10G 5/06 |
| 2009/0031756 | A1 * | 2/2009 | Betting | F25J 3/0238 62/620 |
| 2014/0174122 | A1 * | 6/2014 | Cooper | C10L 3/101 62/618 |
| 2022/0228079 | A1 * | 7/2022 | Meyer | F25J 1/0022 |
| 2022/0228803 | A1 | 7/2022 | Meyer | |

OTHER PUBLICATIONS

"NGL Pro Flare Reduction, NGL Recovery and Gas Conditioning", Aspen Engineering Services, LLC, 23 pgs. (published Mar. 21, 2018) https://documents.pub/document/ngl-pro-flare-reduction-ngl-recovery-and-gas-c-pro-flare-reduction-ngl-recovery.html?page=1.

* cited by examiner

*Primary Examiner* — Matthew R Buck
(74) *Attorney, Agent, or Firm* — Thorpe, North & Western, LLP

(57) ABSTRACT

A natural gas conditioning system for conditioning unconditioned natural gas for use in a gas lift system at a wellbore comprises a series of coolers to receive and cool unconditioned natural gas, and a high-pressure, three-phase separator. The separator receives cooled unconditioned natural gas from the coolers and results in separate flows of conditioned lift gas, waste water and hydro-carbon liquids. The conditioned lift gas can be directed to a first heat exchanger, and the hydro-carbon liquids can be directed to a second heat exchanger. A chiller can be coupled to a third heat exchanger. All the components can be carried by a skid.

17 Claims, 7 Drawing Sheets

APPARATUS FOR CONDITIONING NATURAL GAS FOR USE IN GAS LIFT ARTIFICIAL LIFT APPLICATIONS IN OIL AND GAS PRODUCTION

PRIORITY CLAIM

Priority is claimed to U.S. Provisional Patent Application Ser. No. 62/869,686, filed Jul. 2, 2019, which is hereby incorporated herein by reference.

BACKGROUND

Through the life cycle of a typical oil well, production will transition from a natural flow to some form of artificial lift as the reservoir pressure declines and the well is no longer able to flow under its own pressure. An artificial gas lift uses produced natural gas from the well or field as the lift medium. Produced natural gas, separated from produced oil by onsite production equipment, is compressed and re-injected strategically into the wellbore through specially designed mechanisms where it mixes with the oil in place, reducing the density of the oil sufficiently for the available reservoir pressure to lift the fluids to surface. Current practices typically use the produced natural gas in its raw form directly from the production facilities. The natural gas in this raw state may have high concentrations of water and heavy hydrocarbon liquid (HCL) entrained in the gas. Entrained water may cause damage to surface and downhole equipment, reducing reliability and service life. Entrained HCL may increase the density of the lift gas, which may work counter to the objective of reducing density of the oil in place to encourage flow from the wellbore.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 2:
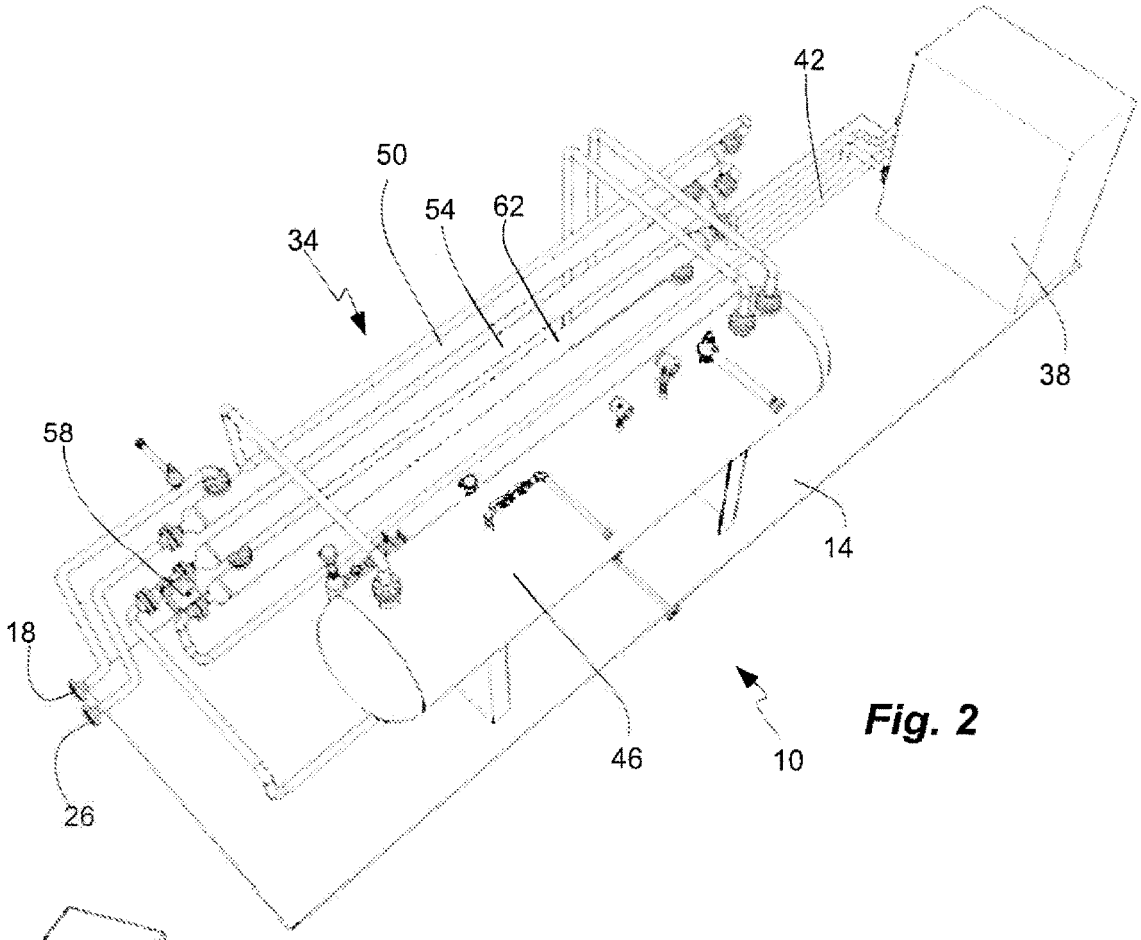
FIG. 2 is a perspective top view of the conditioning system of FIG. 1.
Figure 3:
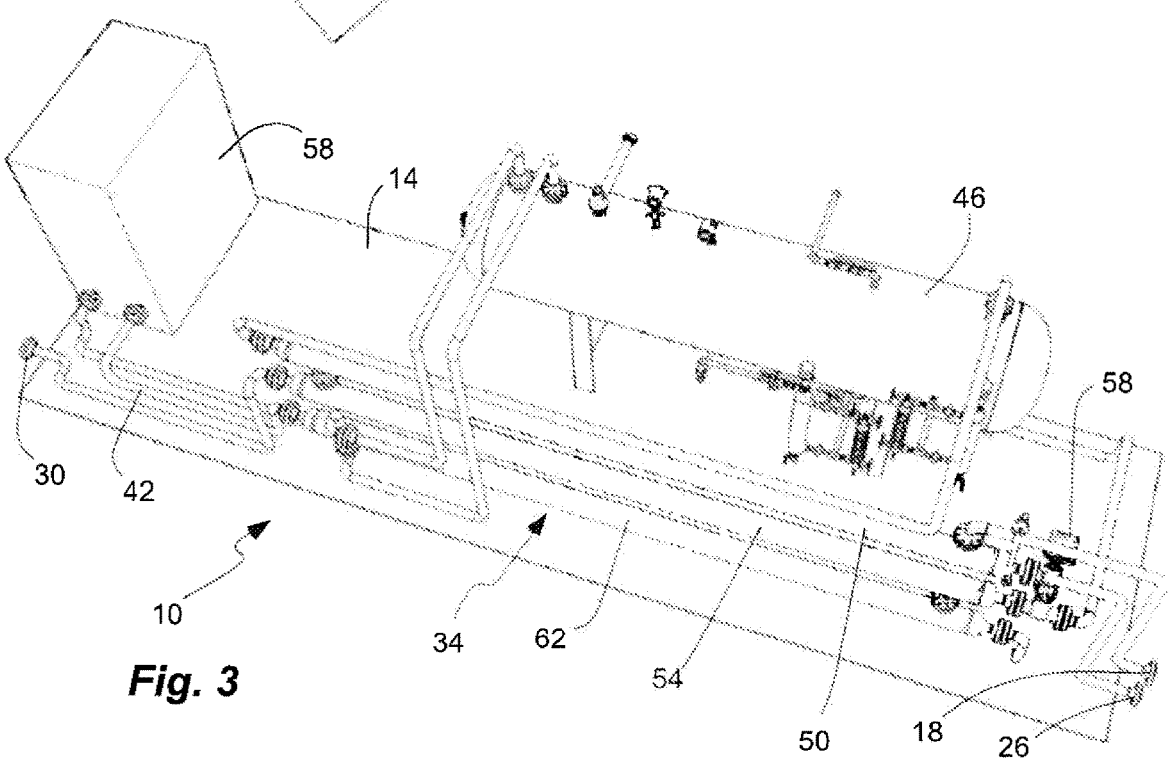
FIG. 3 is a perspective top view of the conditioning system of FIG. 1.
Figure 4:
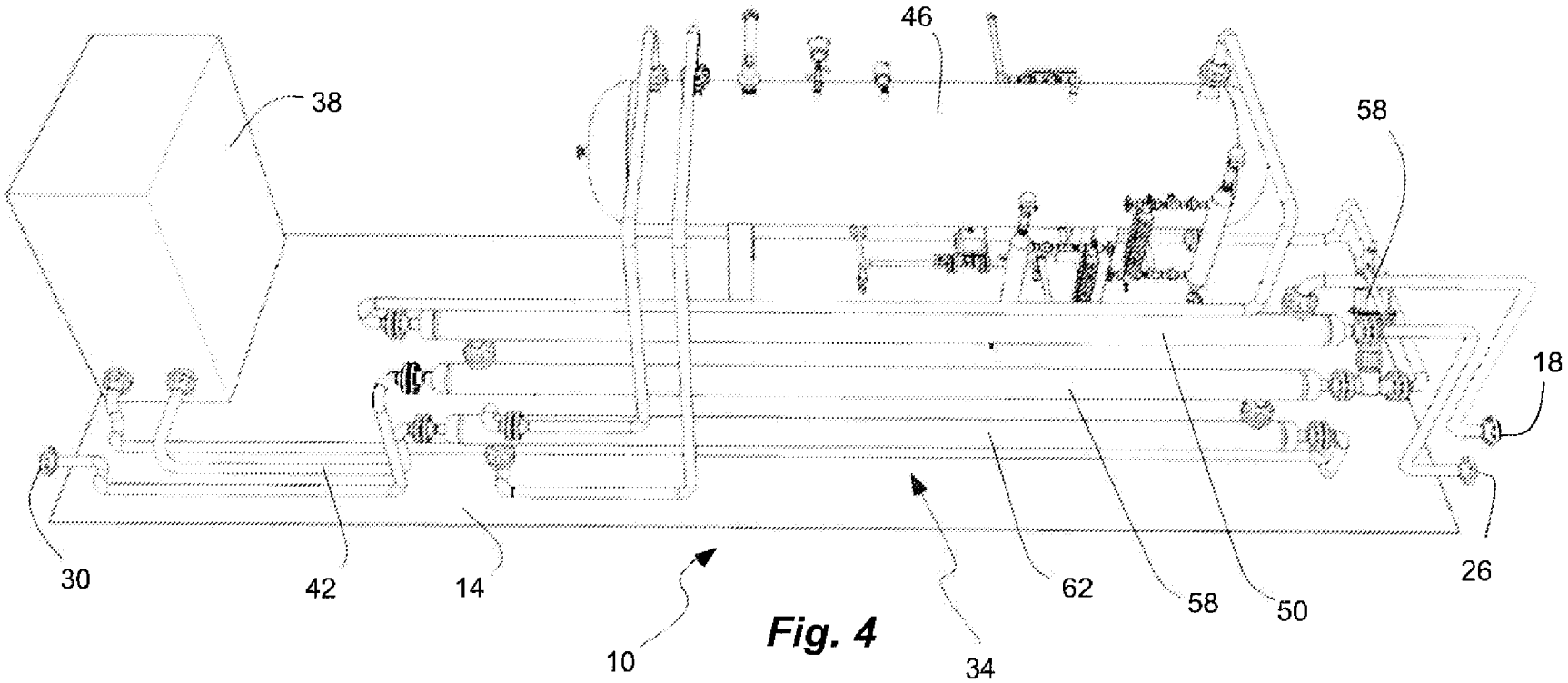
FIG. 4 is a perspective side view of the conditioning system of FIG. 1.
Figure 5:
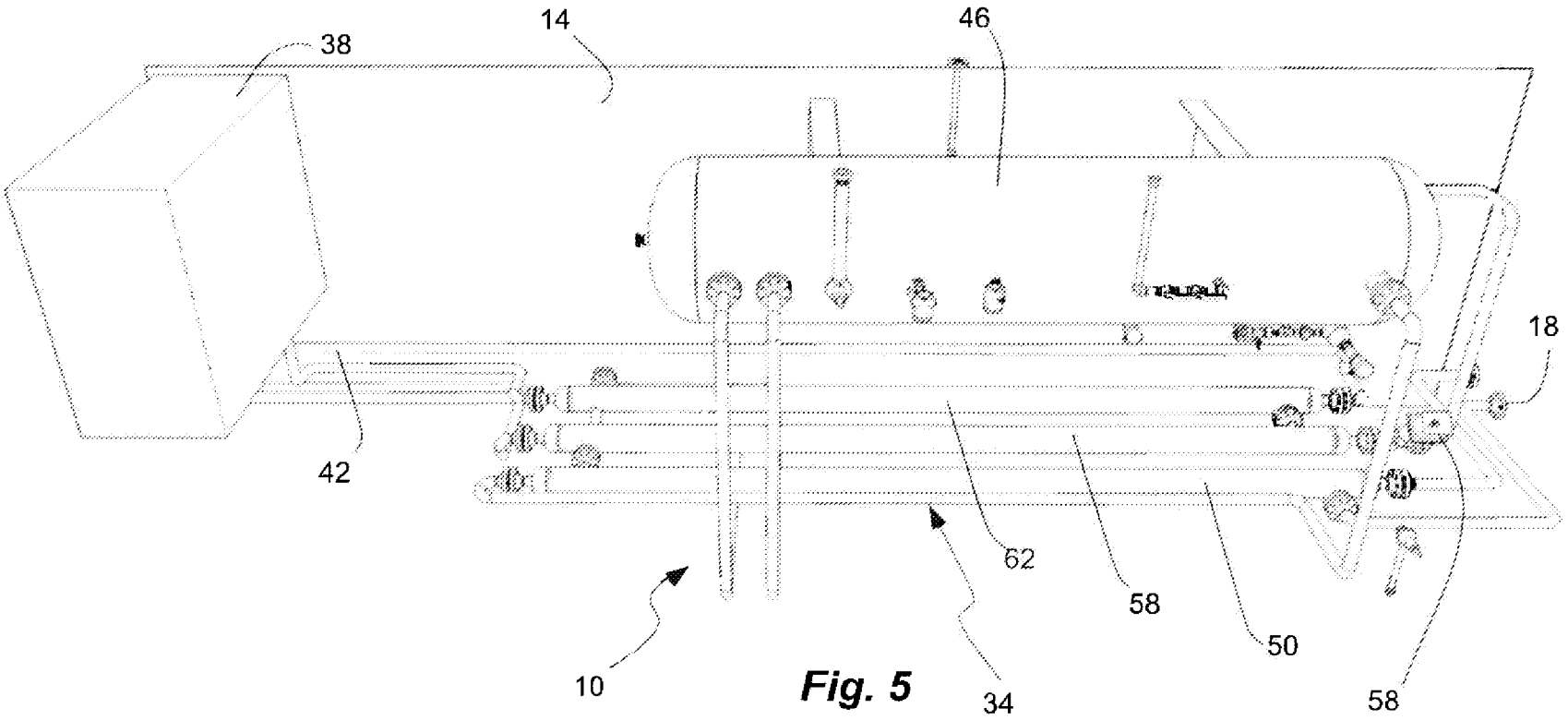
FIG. 5 is a perspective side view of the conditioning system of FIG. 1.
Figure 6:
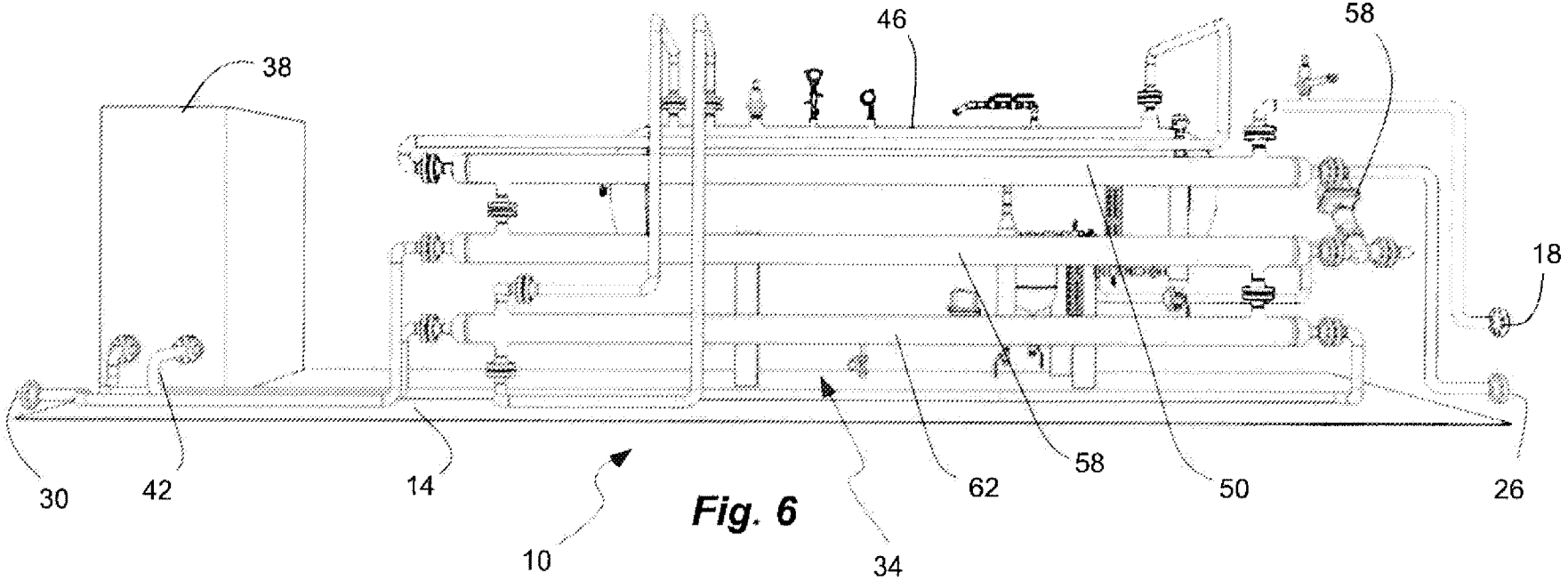
FIG. 6 is a side view of the conditioning system of FIG. 1.
Figure 7:
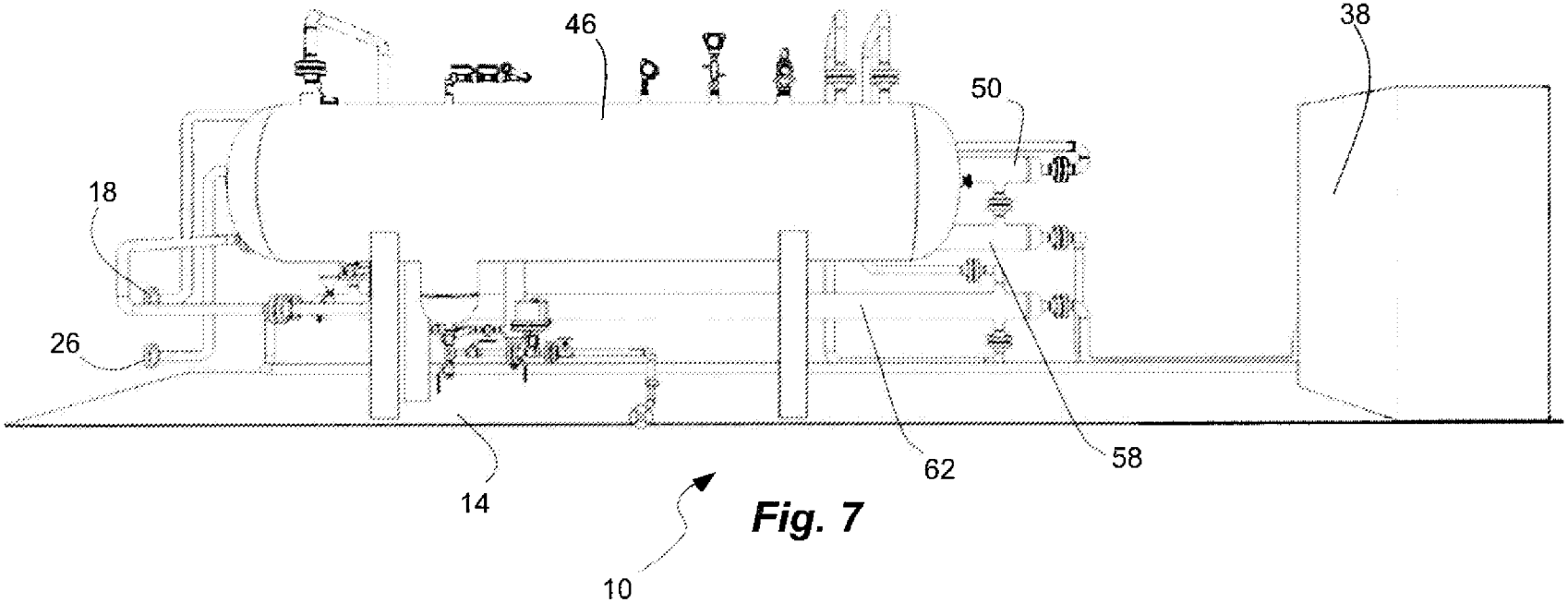
FIG. 7 is a side view of the conditioning system of FIG. 1.
Figure 8:
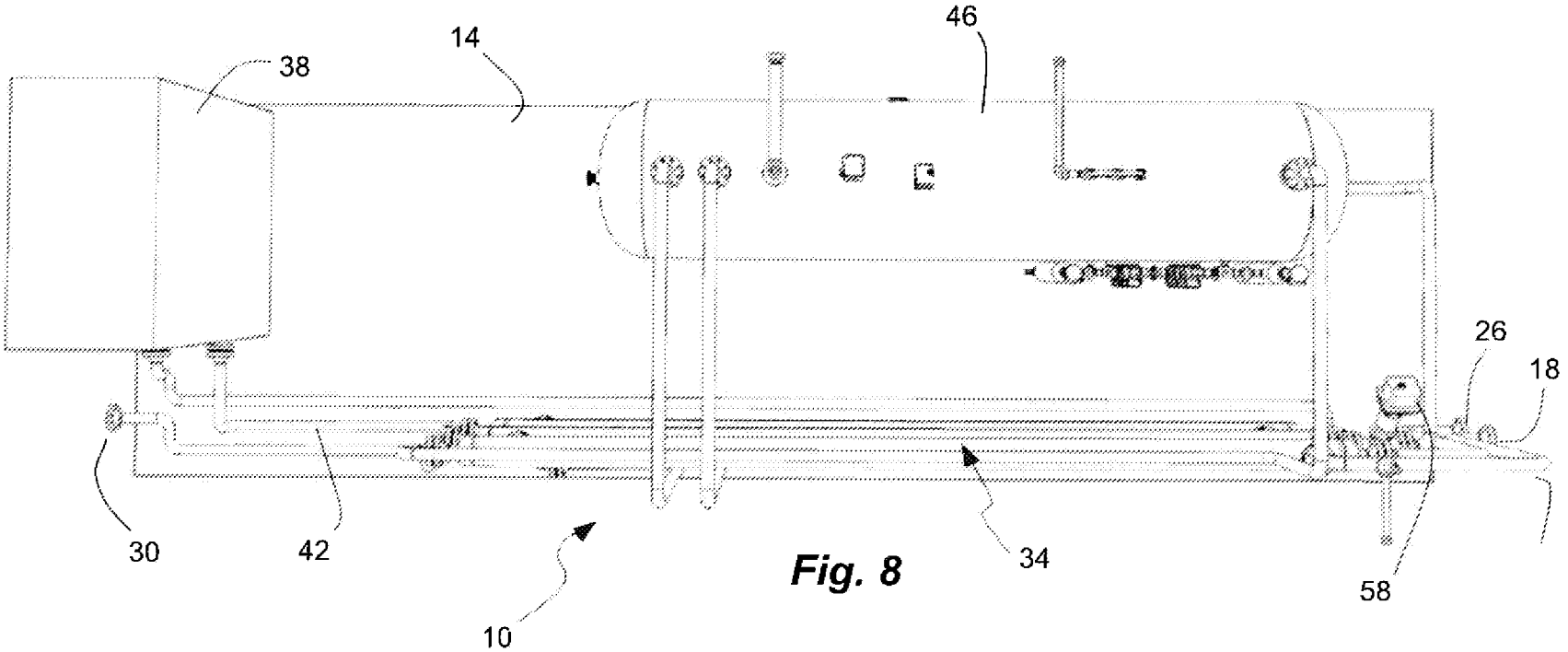
FIG. 8 is a top view of the conditioning system of FIG. 1.

An enclosure of a skid has been removed from FIGS. 2-8 for visibility of interior components.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

It has been recognized that it would be advantageous to develop a system and method to condition the natural gas and to remove the water and HCL in the lift gas. In addition, it has been recognized that it would be advantageous to develop a system and method to improve operational reliability and well productivity. The invention provides conditioning of produced natural gas for the purpose of removing water and HCL to provide a superior medium for use in gas lift artificial lift operations.

The invention provides a natural gas conditioning system for conditioning unconditioned natural gas for use in a gas lift system at a wellbore. The conditioning system comprises: 1) a series of coolers to receive and cool unconditioned natural gas, and 2) a high-pressure, three-phase separator. The separator receives cooled unconditioned natural gas from the coolers and results in separate flows of conditioned lift gas, waste water and hydro-carbon liquids. The conditioned lift gas can be directed to a first, conditioned lift gas and unconditioned natural gas, heat exchanger. Similarly, the hydro-carbon liquids can be directed to a second, hydro-carbon liquid and unconditioned natural gas heat exchanger. A chiller can be coupled to a third, chiller and unconditioned natural gas, heat exchanger. All the components can be carried by a skid for delivery to a wellsite and ease of positioning and use with existing production equipment at the wellsite.

Figure 1:
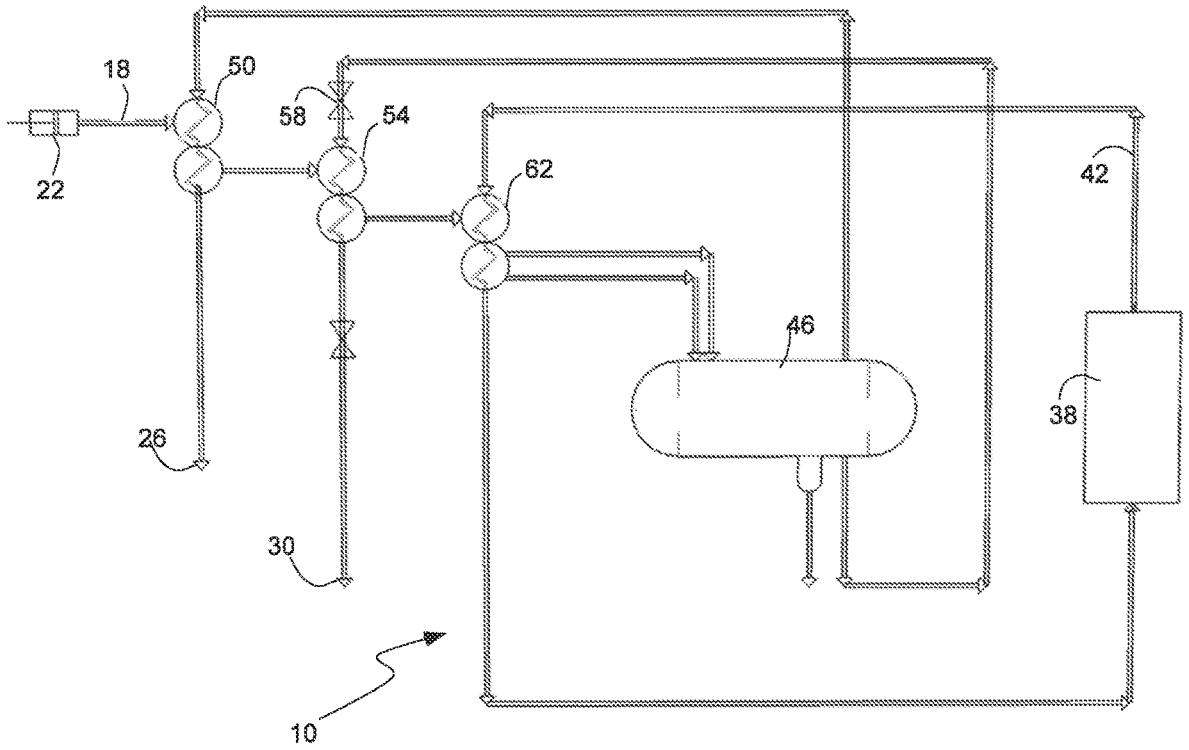
FIG. 1 is a schematic of the conditioning system in accordance with an embodiment of the invention.

Referring to FIGS. 1-8, a natural gas conditioning system 10 is shown by way of example in accordance with an embodiment of the invention. As previously noted, raw and unconditioned natural gas can be received directly from a well or production facility, and injected back into the well as a lift gas to enhance production. The natural gas in this raw state may have high concentrations of water and heavy hydrocarbon liquid (HCL) entrained in the gas. Entrained water may cause damage to surface and downhole equipment, reducing reliability and service life. Entrained HCL can increase the density of the lift gas, which works counter to the objective of reducing density of the oil in place to encourage flow from the wellbore. Thus, the conditioning system 10 receives the unconditioned natural gas produced from the well or production facility, and conditions the unconditioned natural gas to separate and remove water and HCL to produce a conditioned lift gas for injection back into the well as part of the artificial gas lift operation. The conditioning system 10 can cool the unconditioned natural gas prior to separation to improve the efficiency and effectiveness of the separation process.

In one aspect, the conditioning system 10 can comprise a mobile skid 14 that can be transportable, and thus delivered to, and retrieved from, a wellsite. The skid 14 can be received on a truck or trailer for transportation, or can have wheels itself for being towed. The mobility of the skid can facilitate placement at the wellsite with respect to existing production and well equipment. In another aspect, the skid 14 can be enclosed to protect contents from weather and well site elements. The enclosure has been removed from the drawings for visibility of interior components. The skid 14 can have a base that can be disposed on the ground adjacent the well head. All the components necessary for conditioning the natural gas can be carried by the skid 14 as a complete, turn-key system.

The conditioning system 10 and the skid 14 can have an inlet 18, such as unconditioned natural gas inlet, carried by the skid 14 that can be coupled to a natural gas source to receive the unconditioned natural gas. The unconditioned natural gas can be produced from the wellbore or the production facility. In one aspect, the inlet 18 can be coupled directly to the natural gas source, such as the well and associated equipment. In another aspect, the inlet 18 can be coupled to a compressor 22. The compressor 22 can pressurize the produced, unconditioned natural gas. The pressure can be increased to that required for gas lift operations prior to conditioning. Thus, the conditioning system 10 can be configured to condition high-pressure natural gas suitable for use as lift gas in the artificial gas lift system. In another aspect, the unconditioned natural gas can be pre-conditioned before the compressor 22. For example, a slug catcher or condensate collection trap can be positioned before the compressor 22. In one aspect, the slug catcher or condensate collection trap can be carried by the skid 14.

The conditioning system 10 and the skid 14 can also have a lift gas outlet 26 carried by the skid 14 to discharge conditioned natural gas. The lift gas outlet 26 can be coupled to a gas lift control system for injection into a wellbore. In one aspect, the inlet 18 and the lift gas outlet 26 can be located at a same side of the skid 14, such as a shorter side, so that the skid 14 can be positioned adjacent an existing source and flow path for the lift gas operation. In another aspect, the inlet 18 and the lift gas outlet 26 can be located on opposite sides of the skid 14 to facilitate series connection with well equipment. In addition, the system and the skid 14 can have an HCL outlet 30 carried by the skid 14 to discharge HCL removed from the unconditioned natural gas. Similarly, a waste water outlet can discharge water removed from the unconditioned natural gas for proper disposal. In one aspect, the conditioning system 10 and the skid 14 can have one or more reservoirs and tanks to hold the HCL and waste water. The HCL can be held for shipment and sale. The waste water can be held for proper disposal.

The conditioning system 10 cools the unconditioned natural gas and separates it into conditioned lift gas, HCL and waste water. The conditioning system has a series of coolers 34 that first receive and cool the unconditioned natural gas. The series of coolers 34 can utilize the separated lift gas and HCL to cool the unconditioned natural gas, as described below. In addition, the conditioning system 10 has a chiller 38 with a chill loop 42 coupled to the series of coolers 34. The chiller 38 produces cold fluid and circulates the cold fluid through the chill loop 42. In addition, the conditioning system 10 has a high-pressure, three-phase separator 46 coupled to the series of coolers 34 and separates the unconditioned natural gas into separate flows of conditioned lift gas, hydro-carbon liquid (HCL) and waste water. The separator 46 can have controlled pressure and temperature to remove the water and HCL from the compressed, unconditioned natural gas stream. The separator 46 and at least a portion of the series of coolers 34 can be operated at high pressure to maintain the pressure of the unconditioned natural gas, and the conditioned lift gas. Thus, the conditioning system 10 maintains the required high pressure of the lift gas to be used in the artificial lift gas operation. The series of coolers 34, the chiller 38 and the separator 46 can all be carried by the skid 14 and enclosed therein.

The series of coolers 34 can comprise a series of heat exchangers arranged in series between the inlet 18 and the separator 46 to cool the unconditioned natural gas passing from the inlet 18 to the separator 46. Thus, the unconditioned natural gas is first cooled prior to separation by passing through the series of heat exchangers. Cooling the unconditioned natural gas can make the separation process more efficient and effective. A first heat exchanger 50 can be a conditioned lift gas and unconditioned natural gas heat exchanger. The first heat exchanger 50 is coupled between the separator 46 and the lift gas outlet 26, and thus in the lift gas flow, to pass conditioned lift gas from the separator 46 to the lift gas outlet 26. In addition, the first heat exchanger 50 can transfer heat from the unconditioned natural gas to the conditioned lift gas. Thus, the conditioned lift gas is used to cool the unconditioned lift gas.

A second heat exchanger 54 can be a hydro-carbon liquid and unconditioned natural gas heat exchanger. The second heat exchanger 54 is coupled between the separator 46 and the HCL outlet 30, and thus in the HCL flow, to pass HCL from the separator 46 to the HCL outlet 30. In addition, the second heat exchanger 54 can transfer heat from the unconditioned natural gas to the HCL. Thus, the HCL is used to cool the unconditioned lift gas.

In addition, the conditioning system 10 can have an expansion and pressure reduction valve 58 associated with the second heat exchanger 54 and the HCL flow. The expansion valve 58 can be positioned prior to the second heat exchanger 54 in the HCL flow. The expansion valve 58 can expand the HCL, and reduce the pressure of the HCL, and thus cool the HCL prior to second heat exchanger 54. Thus, the HCL can be used for cooling via a Joel-Thomson (JT) effect. While the separator 46 and the first heat exchanger 50 can be operated at high pressure to maintain the high pressure of the lift gas, the pressure of the HCL can be reduced, and the resultant cooling utilized to further cool the unconditioned natural gas. Thus, a portion of the unconditioned natural gas, namely the HCL portion, can be removed, expanded and cooled, and used to cool the unconditioned natural gas.

A third heat exchanger 62 can be a chiller and unconditioned natural gas heat exchanger. The third heat exchanger 62 is coupled to the chiller 38 and the chill loop 42. The chill loop 42 can run through the third heat exchanger 62.

The third head exchanger 62 can transfer heat from the unconditioned natural gas to the cold fluid from the chiller 38. Thus, the cold fluid of the chiller 38 can further cool the unconditioned natural gas. In one aspect, the chiller 38 can transfer heat from the cold fluid to the atmosphere. In another aspect, the chiller 38 can be a refrigeration unit. The chiller 38, and a heat transfer portion thereof, can be located at a side of the skid to transfer heat from the cold fluid to the ambient air.

The series of coolers 34 and the heat exchangers 50, 54 and 62 can be arranged in the order described, and can be positioned one over another in a cascade fashion with the first 50 above the second and third 54 and 62, and the second 54 over the third 62. Thus, the unconditioned natural gas can descend through the heat exchangers 50, 54 and 62 as it cools. In one aspect, the heat exchangers 50, 54 and 62 can be mounted to a wall (removed for clarity) of the skid 14. In another aspect, the heat exchangers 50, 54 and 62 can be mounted from a floor of the skid 14. In another aspect, the heat exchangers 50, 54 and 62 can be supported by the respective piping. The heat exchangers 50, 54 and 62 can be elongated vessels with a center pipe containing the flow of the conditioned lift gas, HCL and cold fluid, and an outer pipe containing the flow of the unconditioned natural gas. The conditioning system 10 can also comprise a control system that can utilize all, or some of, the heat exchangers depending on the operation parameters, such as the ambient temperature, the temperature of the unconditioned natural gas, etc.

As described above, the conditioning system 10 cools the unconditioned natural gas with the series of coolers 34, and the heat exchangers 50, 54 and 62, and then separates the HCL and waste water from the cooled, unconditioned natural gas with the separator 46 resulting in separate flows of the conditioned lift gas, the HCL and the waste water. The conditioned lift gas exits the separator 46 and can be delivered to the gas lift control system for injection into a wellbore. In addition, the conditioned lift gas can be directed to the first heat exchanger 50 to cool the unconditioned natural gas. The HCL removed from the compressed unconditioned natural gas can be collected in the HCL section of the separator 46. In addition, the HCL can be directed to the second heat exchanger 54 to cool the unconditioned natural gas. In another aspect, the HCL can be expanded to further cool the HCL prior to the second heat exchanger 54. In addition, the HCL can be discharged through the HCL outlet 30 for recovery and/or sale. Waste water removed from the compressed unconditioned natural gas can be collected in the waste water section of the separator 46 and disposed of accordingly.

A method for conditioning an unconditioned natural gas can comprise:

1) Cooling the unconditioned natural gas by passing the unconditioned natural gas through at least one cooler, such as the series of coolers 34 and the first, second and/or third heat exchangers 50, 54 and 62 to obtain cooled, unconditioned natural gas. Cooling the unconditioned natural gas includes causing the unconditioned natural gas to be cooled, and causing the unconditioned natural gas to pass through the cooler(s) and heat exchanger(s), such as by providing and positioning the skid 14, and coupling the unconditioned natural gas source to the inlet 18.

2) Separating waste water and HCL from the cooled, unconditioned natural gas by passing the unconditioned natural gas through a high-pressure, three-phase separator 46 resulting in separate flows of conditioned lift gas, waste water and HCL. Separating the waste water and HCL from the unconditioned natural gas includes causing the waste water and HCL to be separated from the unconditioned natural gas, and causing the cooled, unconditioned natural gas to pass through the separator 46. The unconditioned natural gas can be produced by and received from the wellbore or the production facility. In addition, the unconditioned natural gas can be compressed by the compressor 22.

3) Using the conditioned lift gas to cool the unconditioned natural gas by passing the lift gas through the first heat exchanger 50; using the HCL to cool the unconditioned natural gas by passing the HCL through the second heat exchanger 54; and using cold fluid from a chiller 38 to cool the unconditioned natural bas by passing the cold fluid through the third heat exchanger 62.

In accordance with a more detailed aspect, the method can comprise: delivering the conditioned lift gas to a gas lift control system for injection into wellbore; and/or locating a skid with the at least one cooler and the high-pressure, three-phase separator adjacent a wellbore.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A conditioning system configured to condition unconditioned natural gas as conditioned lift gas usable in a gas lift system at a wellbore, the conditioning system comprising:

a) a mobile skid configured to be deliverable to a well site;

b) a series of coolers carried by the skid and comprising first, second and third heat exchangers;

c) a chiller carried by the skid and having a chill loop configured to produce cold fluid and circulate the cold fluid through the chill loop; and d) a high-pressure, three-phase separator carried by the skid and configured to separate unconditioned natural gas into separate flows of conditioned lift gas, hydrocarbon liquid (HCL) and waste water; and e) an inlet carried by the skid and configured to receive unconditioned natural gas; a lift gas outlet carried by the skid and configured to discharge conditioned lift gas; and an HCL outlet configured to discharge the HCL;

f) the series of coolers being coupled between the inlet and the separator and configured to cool unconditioned natural gas passing from the inlet to the separator;

g) the first heat exchanger coupled between the separator and the lift gas outlet and configured to pass conditioned lift gas from the separator to the lift gas outlet and transfer heat from the unconditioned natural gas to the conditioned lift gas;

h) the second heat exchanger coupled between the separator and the HCL outlet and configured to pass the HCL from the separator to the HCL outlet and to transfer heat from the unconditioned natural gas to the HCL; and i) the third heat exchanger coupled to the chiller and configured to transfer heat from the unconditioned natural gas to the cold fluid.

2. The conditioning system in accordance with claim 1, further comprising:

an expansion valve associated with the second heat exchanger and configured to expand the HCL, and thus cool the HCL.

3. The conditioning system in accordance with claim 1, further comprising:

the inlet and the lift gas outlet being located at a same side of the skid.

4. The conditioning system in accordance with claim 1, wherein the inlet is coupled to a compressor.

5. The conditioning system in accordance with claim 1, wherein the inlet is coupled to a natural gas source and configured to receive produced natural gas produced from a wellbore.

6. The conditioning system in accordance with claim 1, wherein the lift gas outlet is coupled to a gas lift control system for injection into the wellbore.

7. A conditioning system configured to condition unconditioned natural gas as conditioned lift gas, the conditioning system comprising:

a) a series of coolers configured to receive and cool the unconditioned natural gas, b) a chiller having a chill loop coupled to the series of coolers and configured to produce cold fluid and circulate the cold fluid through the chill loop;

c) a high-pressure, three-phase separator coupled to the series of coolers and configured to separate unconditioned natural gas into separate flows of conditioned lift gas, hydro-carbon liquid (HCL) and waste water;

d) the series of coolers comprising:

i) a first heat exchanger coupled to the separator to receive and pass conditioned lift gas and configured to transfer heat from the unconditioned natural gas to the conditioned lift gas;

ii) a second heat exchanger coupled to the first heat exchanger and the separator to receive and pass the HCL and configured to transfer heat from the unconditioned natural gas to the HCL; and iii) a third heat exchanger coupled to the second heat exchanger and the chiller loop and configured to transfer heat from the unconditioned natural gas to the cold fluid; and e) an expansion valve associated with the second heat exchanger and configured to expand the HCL, and thus cool the HCL prior to the second heat exchanger.

8. The conditioning system in accordance with claim 7, further comprising:

a mobile skid carrying the series of coolers, the chiller, the separator and the expansion valve, the mobile skid configured to be deliverable to a well site.

9. The conditioning system in accordance with claim 8, further comprising:

a) an inlet carried by the skid and configured to be coupled to a natural gas source and configured to receive produced natural gas produced from a wellbore or a production facility;

b) a conditioned lift gas outlet carried by the skid; and c) the inlet and the lift gas outlet being located at a same side of the skid.

10. The conditioning system in accordance with claim 9, wherein the inlet is coupled to a compressor.

11. The conditioning system in accordance with claim 9, wherein the inlet is coupled to a natural gas source and configured to receive produced natural gas produced from the wellbore.

12. The conditioning system in accordance with claim 9, wherein the lift gas outlet is coupled to a gas lift control system for injection into a wellbore.

13. A method for conditioning an unconditioned natural gas, the method comprising:

a) cooling the unconditioned natural gas by passing the unconditioned natural gas through a series of coolers including first, second and third heat exchangers, defining cooled unconditioned natural gas;

b) separating waste water and hydro-carbon liquids from the cooled unconditioned natural gas by passing the cooled unconditioned natural gas through a high-pressure, three-phase separator resulting in separate flows of conditioned lift gas, hydro-carbon liquid (HCL) and waste water, and using the conditioned lift gas to cool the unconditioned natural gas by passing the lift gas through the first heat exchanger, using the HCL to cool the unconditioned natural gas by passing the HCL through the second heat exchanger, and using cold fluid from a chiller to cool the unconditioned natural gas passing the cold fluid through the third heat exchanger; and delivering the conditioned lift gas to a gas lift control system for injection into a wellbore.

14. The method in accordance with claim 13, further comprising:

receiving produced unconditioned natural gas produced from the wellbore.

15. The method in accordance with claim 13, further comprising:

compressing the unconditioned natural gas with a compressor prior to cooling.

16. The method in accordance with claim 13, further comprising:

locating a skid with the series of coolers, the separator and the chiller adjacent the wellbore.

17. The method in accordance with claim 13, further comprising:

expanding the HCL prior to the second heat exchanger with an expansion valve to reduce pressure of, and cool, the HCL.

* * * * *